US005501155A

United States Patent [19]

Hollis et al.

[11] Patent Number: 5,501,155

[45] Date of Patent: Mar. 26, 1996

[54] HOLLOW TRAINING ROUND

[75] Inventors: Michael S. L. Hollis, Abingdon; Fred J. Brandon, Aberdeen; Edward W. Kennedy, Baltimore; Edward M. Schmidt, Forest Hill, all of Md.

[73] Assignee: The United States of America as represented by the Secretary of the Army, Washington, D.C.

[21] Appl. No.: 327,770

[22] Filed: Oct. 24, 1994

[51] Int. Cl.[6] ..... F42B 8/12

[52] U.S. Cl. ..... 102/529; 102/517

[58] Field of Search ..... 102/395, 498, 102/501, 502, 517, 520–523, 529, 703; 244/3.3

[56] References Cited

U.S. PATENT DOCUMENTS

| | | | |
|---|---|---|---|
| 3,442,205 | 5/1969 | Stadler et al. | 102/529 |
| 3,848,532 | 11/1974 | Abbott | 102/529 |
| 3,911,824 | 10/1975 | Barr et al. | 102/502 |
| 4,215,632 | 8/1980 | Sie | 102/529 |
| 4,362,107 | 12/1982 | Romer et al. | 102/520 |
| 4,596,191 | 6/1986 | Glotz et al. | 102/529 |
| 4,664,664 | 5/1987 | Drake, Jr. | 102/502 |
| 4,798,144 | 1/1989 | Aphott | 102/529 |
| 5,001,986 | 3/1991 | Meister | 102/529 |
| 5,259,319 | 11/1993 | Dravecky et al. | 102/529 |
| 5,363,769 | 11/1994 | Bellak et al. | 102/529 |

FOREIGN PATENT DOCUMENTS

| | | | |
|---|---|---|---|
| 407288 | 1/1991 | European Pat. Off. | 102/498 |
| 2080926 | 2/1982 | United Kingdom | 102/522 |
| 2115118 | 9/1983 | United Kingdom | 102/529 |

*Primary Examiner*—Harold J. Tudor

*Attorney, Agent, or Firm*—Freda L. Krosnick; Muzio B. Roberto

[57] ABSTRACT

A fin stabilized kinetic energy tank training device comprising a projectile having a nose and having nose and end sections, and constructed of a low density material such as aluminum, and having a hollowed-out section to further reduce weight thereof, so as to minimizing penetration of an armor system on impact thereon.

2 Claims, 3 Drawing Sheets

FIG. (1a)
PRIOR ART

HOLLOW TRAINING ROUND

RIGHTS OF GOVERNMENT

The invention described herein may be manufactured, used and licensed by or for the Government for Governments purpose without the payment to us of any royalties thereon.

BACKGROUND OF INVENTION

1. Field of Invention

This invention relates to a discarding sabot, kinetic energy tank training round.

2. Description of Related Art

Currently, there are several steel cored, discarding sabot, kinetic tank training rounds in use by the Army. One is a cone-shaped, spin-stabilized training device known as the M 724 which is fired from a M67 series 105 mm rifled gun tube. The other training rounds are flare-stabilized. They are the D128, which is fired from a M68 series gun tube, and both the M865 and the M865 Product Improved Projectile (PIP). The M865 series are fired from a 120 mm M256 smooth-bore gun tube. The M865 consists of two sections, i.e. a steel core projectile, and an aluminum flare for stabilization.

A disadvantage of the above identified training rounds is that they are able to penetrate a significant armor thickness. Accordingly, a need existed for a training round having neglible penetration of an armor system.

Other training rounds are known in the art, for example, U.S. Pat. No. 4,882,997 discloses a tubular projectile suitable for use in training ammunition, comprising a hollow tube having formed in the rear end of the rubber wall thereof a recess in which is embedded a tracer material.

U.S. Pat. No. 4,508,036 discloses a training round having a synthetic resin projectile, or dummy projectile, wherein the projectile or dummy projectile is integrally molded to a synthetic resin sleeve or tube opening at thereon end.

However, none of the prior art devices are directed to a training device compatible with existing rounds, and having the ability to minimize armor penetration.

SUMMARY OF THE INVENTION

During a training exercise, a round may be accidential fired at another armored vehicle. The primary purpose of of this invention is to significantly diminish terminal effects such as personnel death, injury and/or vehicle damage in the case of an accidential firing and hit of armored vehicle with a training round.

The present invention relates to an improvement to existing steel-cored, discarding-sabot, kinetic energy tank training rounds, and the spin stabilized, discarding sabot, kinetic energy tank training round. This invention would reduce lethality, i.e., personnel deaths, injury, material loss, and damage, yet retain the same flight characteristics (a ballistic match) to existing rounds. This would not require any changes to the existing tank fire-control system.

The lethality of the training round significantly diminishes by replacing the steel core of a projectile body of the training round with a material of lesser density such as aluminum, and further hollowing out the aluminum projectile.

It is an object of the invention to provide and disclose a training round having diminished lethality.

It is a further object of the invention to provide and disclose a training round having diminished capacity to significantly penetrate armor.

It is a further object of this invention to provide and disclose a training round having a projectile made of a low density metal.

It is a further object of the invention to provide and disclose a training round composed of a low density metal which has been hollowed out.

Other objects and a fuller understanding of the invention may be ascertained from the following description and claims.

FIG. (1*a*) is an aft view of the 120 mm M865 Tank Training Round showing a flared view of round.

Figure 2:
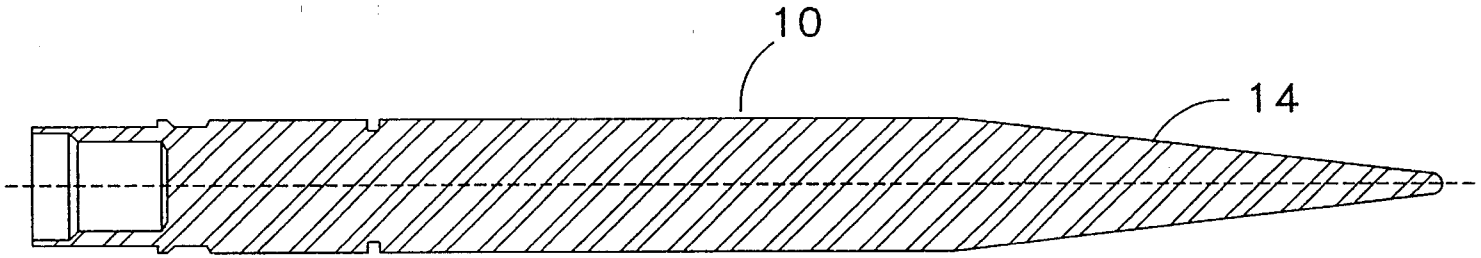
FIG. 2 PRIOR ART

FIG. 2 is a sectional side view of the M865 steel core projectile

Figure 3:
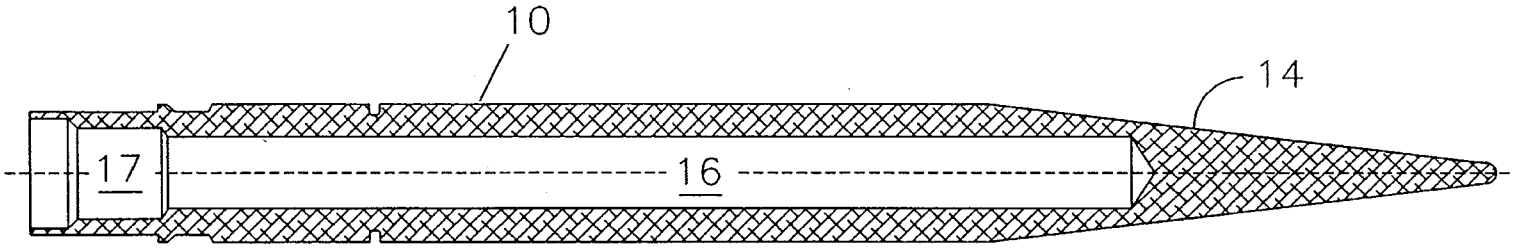

FIG. 3 is a sectional view of a hollow aluminum projectile of the present invention.

Figure 4:
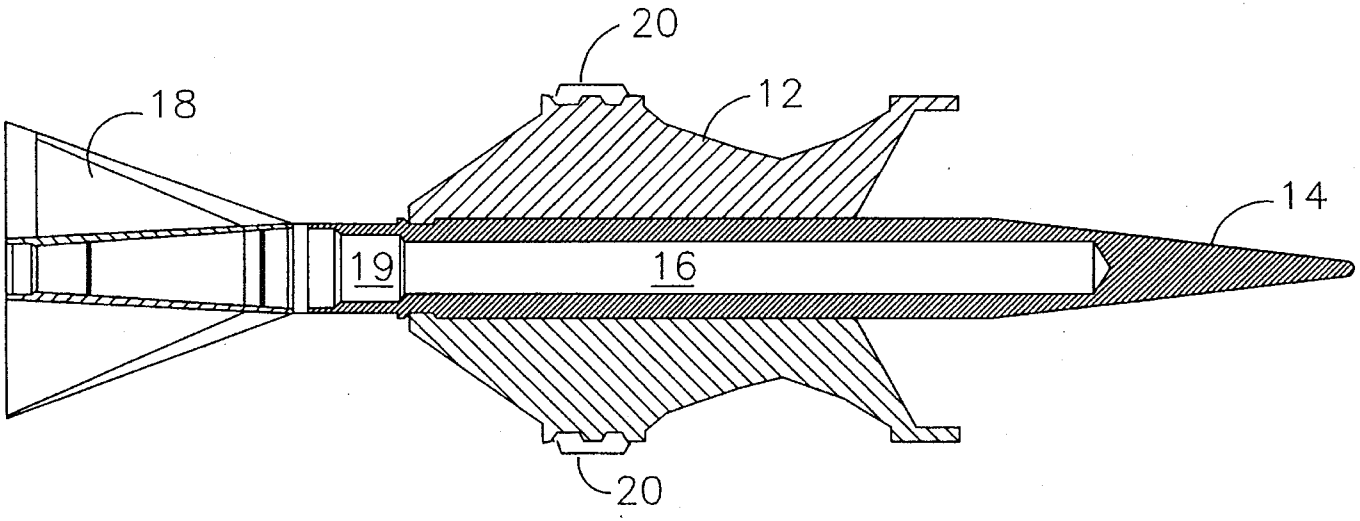

FIG. 4 is a sectional view of the training round in combination with a delivery system.

Figure 1:
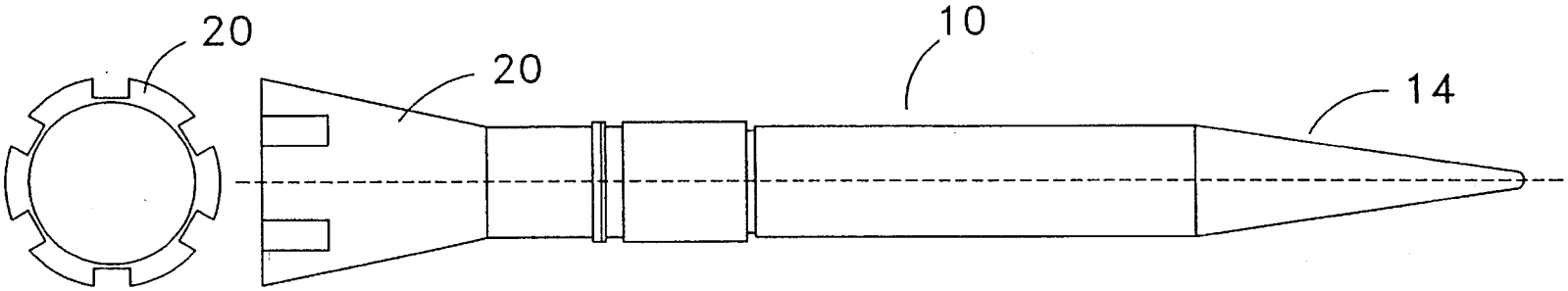
FIG. 1 PRIOR ART
FIG. 1 is a side view of the 120 mm M 865 Tank Training Round.
Figure 5:
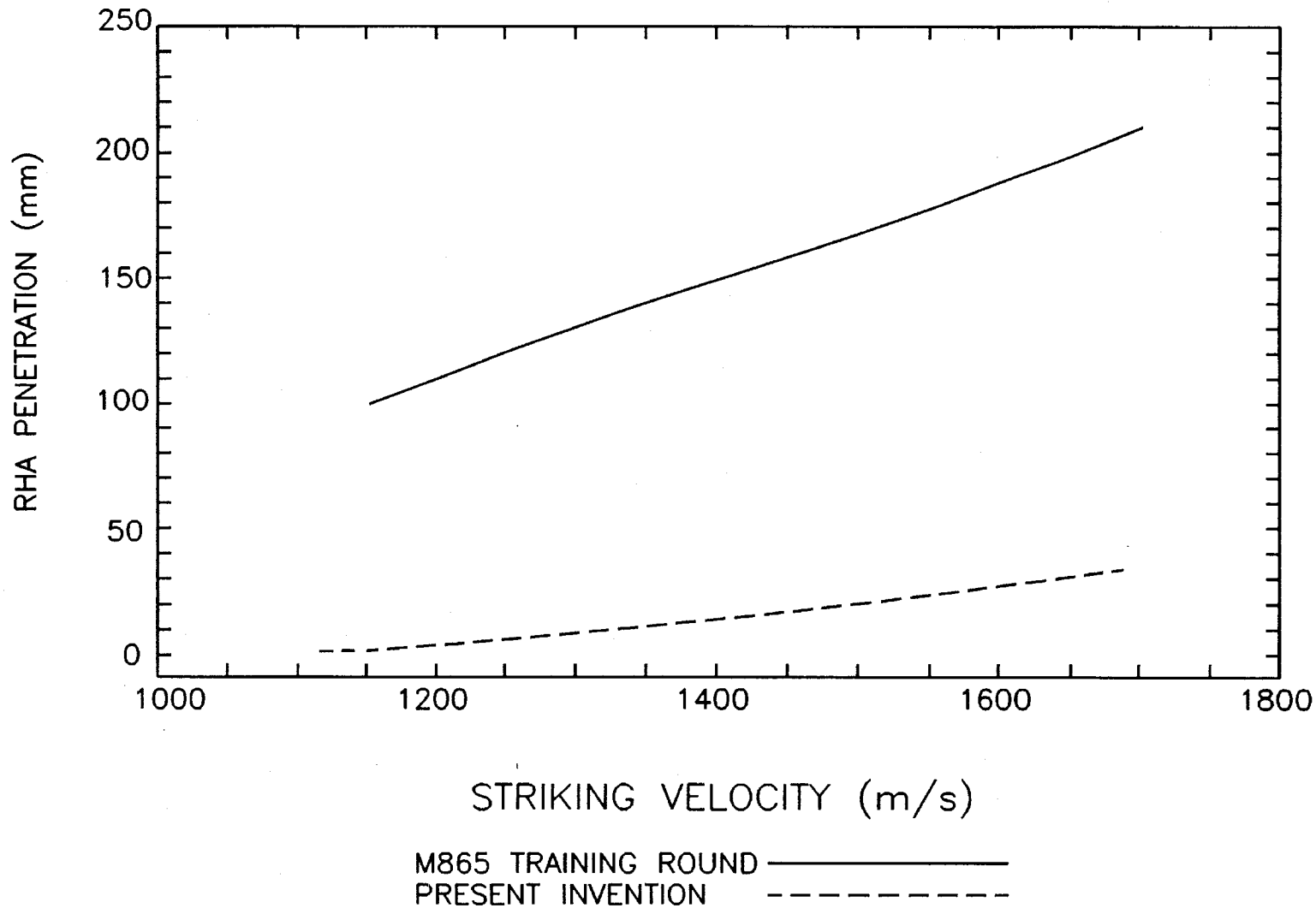

FIG. 5 is a graph showing a comparison of the penetration of a RHA steel plate using a M865 training round of FIG. 1. and a training round of the present invention.

Referring now to FIG. 3 of the drawing, the present invention comprises projectile 10 suitable designed to be comparable with sabot 12. The projectile has conical or ogival nose section 14, elongated midsection 15, having hollowed-out section 16 starting from behind the nose section, and running laterally along the projectile to near the end section thereof. Near an end section is reduced section 17, suitable contoured to receive plug adapter 19. Stabilizer 18 is employed on the end of the projectile to reduce drag. The system comprises enlarged section 17, suitable contoured to receive plug adapter 19.

The 120 mm M865 Training Round is show in FIG. 1. The system comprises nose section 14, elongated section 15, and flared end section 20.

FIG. 4 shows the projectile in combination with a delivery system comprising sabot 12 having obturator 13.

FIG. 5 is a graph showing the effectiveness of the present invention, i.e., a projectile made out of hollowed-aluminum in diminished penetration of a steel armor plate, compared with the M865 training round.

The graph discloses that the penetration of the RHA steel plate was about 80 mm to about 230 mm based on a striking velocity of about 1100 to 1700 using the M865 core projectile.

Under identical conditions, penetration of the RHA plate was about 20 to 60 mm based on a striking velocity of about 1100 to 1700, using the present invention. This shows a significant reduction in armor penetration using the present invention.

As an alternative to the hollowed-aluminum projectile, such as, for example, solid plastic/composite projectiles, and magnesium cored projectile may be used.

Although, we have described our invention with a certain degree of particularity, it is understood that modifications may made without departing from the spirit and scope of the present invention.

Having described our invention, we claim:

1. A fin stabilized kinetic tank training round comprising:

a one piece projectile having a closed nose end section, fin stabilized means employed at an end of the projectile, the projectile suitably contoured to be compatible with a sabot, the projectile constructed of a low density material selected from the group consisting aluminum and magnesium having a continuous hollowed-out section starting immediately behind the closed nose section and running along the axis of the projectile to an end section thereof, so that on the firing of the training round, the capability of the projectile to penetrate the target is significantly reduced.

2. A training round in accordance with claim 1 wherein the low density material is aluminum.

* * * * *